US007184069B2

(12) United States Patent
Yamamoto et al.

(10) Patent No.: US 7,184,069 B2
(45) Date of Patent: Feb. 27, 2007

(54) IMAGE-ERASING APPARATUS AND IMAGE-ERASING METHOD

(75) Inventors: Keiichi Yamamoto, Yokohama (JP); Shoji Usuki, Yokohama (JP); Mitsuhiro Maida, Koto-Ku (JP); Kesato Kishimoto, Yokohama (JP); Hiroaki Abe, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 183 days.

(21) Appl. No.: 11/004,002

(22) Filed: Dec. 6, 2004

(65) Prior Publication Data

US 2005/0134670 A1 Jun. 23, 2005

(30) Foreign Application Priority Data

Dec. 8, 2003 (JP) ..... 2003-409436
May 13, 2004 (JP) ..... 2004-143936

(51) Int. Cl.
*B41J 29/26* (2006.01)
*B41M 7/00* (2006.01)

(52) U.S. Cl. ..... 347/179

(58) Field of Classification Search ..... 347/179, 347/223

See application file for complete search history.

(56) References Cited

U.S. PATENT DOCUMENTS 5,237,338 A * 8/1993 Stephenson ..... 347/223
6,154,243 A * 11/2000 Tatewaki et al. ..... 347/223

FOREIGN PATENT DOCUMENTS

| | | |
|---|---|---|
| JP | 5-301417 | * 11/1993 |
| JP | 6-47990 | * 2/1994 |
| JP | 11-212410 | 8/1999 |
| JP | 2000-108392 | * 4/2000 |
| JP | 2000-191155 | * 7/2000 |
| JP | 2002-254684 | * 9/2002 |

* cited by examiner

*Primary Examiner*—Huan Tran
(74) *Attorney, Agent, or Firm*—Oblon, Spivak, McClelland, Maier & Neustadt, P.C.

(57) ABSTRACT

An apparatus for erasing an image formed, on a medium, with an erasable image-forming material by heating the medium includes a heating unit for electrically heating the image formed, on an medium, with an erasable image-forming material, at a predetermined temperature. The image-erasing apparatus may further include a substance treating unit for decomposing and/or adsorbing the substances produced in the heating step.

27 Claims, 6 Drawing Sheets

IMAGE-ERASING APPARATUS AND IMAGE-ERASING METHOD

BACKGROUND OF THE INVENTION

1. Field of the Invention

The present invention relates to an image-erasing apparatus for erasing an image formed, on a medium such as recording paper, with an erasable image-forming material and also relates to an image-erasing method of erasing an image formed, on the medium, with an erasable image-forming material.

2. Related Art

With the recent spread in office automation, the volume of various types of information has significantly increased, and information output has increased accordingly. Outputting on a sheet of paper from an image-forming apparatus such as a printer or a copying machine is well known as a mode of information output. As the amount of information increases, large amounts of sheets of paper as a recording medium have been used. This constitutes a problem in view of resource conservation. In order to recycle the sheets of paper once printed with a printer or a copying machine, large amounts of a bleaching agent and water are needed. The cost of recycling also increases when a large quantity of sheet of paper (which may be called merely paper or papers hereinlater) is used.

An erasable image-forming material is used to form, i.e., print, an image on a sheet of paper. The formed image is erased with an image-erasing apparatus so that the sheet of paper can be returned as a blank paper. In this way, the paper can be reused repeatedly, and therefore, the number of sheets of paper required can be substantially reduced. When the quality of the paper is significantly degraded due to repeated reuse, the paper is recycled. In this way, the total cost of reuse of the paper can be reduced.

Generally, an image-erasing apparatus is an apparatus for erasing an image formed on a recording medium (for example, a sheet of paper) with an image-forming apparatus such as a printer or a copying machine. The image-erasing apparatus includes a printing unit which uses toner or ink made of an erasable image-forming material and an erasing unit for removing the toner or the ink.

Japanese Unexamined Patent Application Publication No. HEI 11-316527 discloses an image-erasing apparatus including a device for contacting a solvent to an erasable image-forming material which develops color on a sheet of paper, and a device for removing the solvent from the paper. The erasable image-forming material includes a color former, a developer, and a decolorizer. The solvent dissolves the developer and the decolorizer. This publication provides an erasable image-forming material, and the image is erased by adding solvent or applying heat to thereby reuse the paper.

Further, in order to widely develop such erasable image-forming material, it is necessary to develop or study materials as well as printers or like using such erasable image-forming material and it is also necessary to develop the image-erasing apparatus suitable for office work.

Japanese Unexamined Patent Application Publication Nos. 2000-28450 and 2002-38039 disclose erasable image-forming materials. The images formed with the erasable materials are erased by a solvent or by the application of heat. These materials make it possible to reuse the paper.

In order for the above-described erasable image-forming materials to be used on a more widespread basis, in addition to the development of the materials and the development of printers and copying machines capable of using such materials, the development of image-erasing apparatuses capable of being used in an office is also necessary.

However, conventional image-erasing apparatuses require a solvent container for storing the solvent used for the erasing and a recovered-solvent container into which used solvent is recovered. In addition, a conventional image-erasing apparatus requires a carrying-in roller and a carrying-out roller for bringing the paper into contact with the solvent, a heat roller and an electronic cooler for controlling the temperature, and chemicals such as an adsorbent. Moreover, a conventional image-erasing apparatus also requires a drive mechanism such as a circulation pump. Therefore, the overall structure of the image-erasing apparatus and the erasing process by using such apparatus are complex. In addition, it is necessary to carefully handle the used solvent for safety.

For this reason, an image-erasing apparatus using the solvent is not suitable for use in an office. Therefore, it is desired to realize an image-erasing apparatus suitable for office work of the structure that does not discharge or harmful substance or pollution such as exhaust gas, requires less installation location, is compact in size, and requires less power.

In the meantime, as a concrete erasing method using the image erasing apparatus for erasing the image formed on the medium such as recording paper, there are provided, for example, a method of using a solvent and a method of utilizing heat, as briefly mentioned hereinbefore. On the other hand, as treating or disposed method, there are provided, for example, a mass treatment method in which papers printed with the erasable image-forming materials are collected from offices or working departments and simultaneously treated, and a dispersion (or separate) treatment method in which papers printed with the erasable image-forming materials are treated separately at portions near printers or copying machines utilized for the printing treatment.

In the case of the mass treatment method, the erasing apparatus becomes large or big in size, which will require a specific room, chamber or building for treatment and in the case of the separate treatment method, a small-sized erasing apparatus is usable, being convenient in usual office work or treatment in office.

Moreover, in the case of using the solvent, the use of volatile organic solvent is not suitable and dangerous for the use in the office or like. In this meaning, the thermal erasing method, using no organic solvent, may be suitable for the erasing apparatus of the image-forming material.

However, the image-forming material erasing method or apparatus mentioned above provides the following undesirable matters.

That is, in the conventional erasing apparatus for the image-forming material, paper as a recording medium is also heated together with the printed image-forming material at the image erasing treatment time. Papers are usually classified into acid papers and neutral papers in accordance with their manufacturing methods. In a usual paper manufacturing process, an ink bleeding-stop agent (sizing agent), such as colophonium, is added, and in order to fix such colophonium to the paper, aluminium sulfate is generally utilized. The aluminium sulfate has a function of reacting to water to thereby generate acid and make the paper as acid paper. Therefore, the paper using the aluminium sulfate is generally called "acid paper", in which cellulose as fiber of the paper is apt to be damaged, which provides a problem of durability of the paper. In view of this matter, a paper utilizing a neutral material as sizing agent has been used to improve the durability of the paper, which is, on the other hand, called "neutral paper". In addition, in further consideration of preservation of the paper, such as calcium carbonate is added to neutralize acid in atmosphere to thereby keep weak alkaline property of the paper.

As mentioned above, various chemical treatments have been usually effected to the general papers in their manufacturing process.

Furthermore, the erasable image-forming material is erased by heating a medium such as recording paper on which the image is formed at a predetermined temperature. However, when the sheet of paper is heated, in some cases, the components, such as those mentioned above, contained in the paper may be evaporated and an odor generating substance may be produced, such as, for example, benzaldehyde, octanol, or like. Such odor or odor generating substance will be dispersed at the erasing time in a room in which the erasing apparatus is set. This matter may also constitute an adverse problem if the room is not so wide.

SUMMARY OF THE INVENTION

The present invention was conceived in consideration of the above matters encountered in the prior art mentioned above, and an object of the present invention is therefore to provide an image-erasing apparatus capable of effectively erasing an image formed, on a recording medium, with an erasable image-forming material with high safeness and being compact and suitable for use in an enclosed area such as an office.

Another object of the present invention is to provide an image-erasing apparatus and method capable of preventing generation of odor substance which may be generated at the time of heating and erasing a recording medium such as image-forming material with low cost.

These above and other objects can be achieved according to the present invention by providing, in one aspect, an apparatus for erasing an image formed, on a medium, with an erasable image-forming material by heating the medium, comprising:

a heating unit for electrically heating the image formed, on an medium, with an erasable image-forming material, at a predetermined temperature, preferably in a range of 120° C. to 150° C.; and a power source connected to the heating unit so as to supply an electric power to heat the heating unit.

In preferred embodiments, the heating unit may include: two heating plates between which the medium is disposed with being sandwiched from front and back surface sides thereof; and two heaters electrically connected to the power source and attached to the heating plates, respectively, for heating the two heating plates.

The image-erasing apparatus may further include additional two heating plates and two heaters disposed on two side portions, opposing to each other, of the medium so as to surround the medium from four directions by the first mentioned two heating plates and heaters and the latter mentioned two heating plates and heaters, or the image-erasing apparatus may further include further additional two heating plates and two heaters disposed on two side portions, opposing to each other, other than two sides mentioned above, of the medium so as to surround the medium from six directions by the four heating plates and four heaters and the further mentioned two heating plates and two heaters.

The image-erasing apparatus may further include two heat reflecting plates disposed on two side portions, opposing to each other, of the medium so as to surround the medium from four directions by the two heating plates and two heat reflecting plates, or the image-erasing apparatus may further include further additional two heat reflecting plates disposed on two side portions, opposing to each other, other than two sides mentioned above, of the medium so as to surround the medium from six directions by the two heating plates and the first mentioned two heat reflecting plates and the latter mentioned two heat-reflecting plates.

The image-erasing apparatus may further include a tray in which the medium is accommodated and which is heated by the heating unit.

The apparatus may further include a fan disposed so as to blow an air to the heating unit to cool the same.

The image-erasing apparatus may further include a heat-blocking plate operatively connected to a surface of the heating unit opposing to a surface thereof contacting to the heating unit on at least one of front and rear surface sides of the medium so as to reflect the heat from the heating unit.

The heating unit may include two heating plates between which the medium is disposed with being sandwiched from front and back surface sides thereof and two heaters electrically connected to the power source and attached to the heating plates, respectively, for heating the two heating plates, and further comprising two heat-blocking plates disposed on outsides of both the heating units through a spacer on one side and an elastic member on the other side.

It is desirable to form the elastic member with a plurality of springs.

Furthermore, it may be desired that the heating unit includes a single heating plate and a single heater attached to the heating plate, and further comprises three heat reflecting plates including one heat reflecting plate disposed so as to face the heating plate to thereby sandwich the medium therebetween and two heat reflecting plates disposed on both side surfaces of the medium so as to surround the medium from four directions by the one heating plate and three heat reflecting plates. The image-erasing apparatus of this embodiment may further include further additional two heat reflecting plates disposed on two side portions, opposing to each other, other than two sides mentioned above, of the medium so as to surround the medium from six directions by the one heating plates and the first mentioned two heat reflecting plates and the latter mentioned two heat reflecting plates.

In a further preferred embodiment, the image-erasing apparatus may further include an outer case in which the heating unit and a fan for cooling the heating unit are disposed, the case being provided with an air inlet through which air is introduced inside the case and an air outlet through which the air is discharged outside the case.

In the preferred embodiment provided with the case, a control unit may be disposed in the case and electrically connected to the heating unit and the fan for automatically controlling an operation of the heating unit and the fan, and an interlock mechanism may be further disposed in the case for interlocking the case.

A handle may be attached to the case so as to carry the case.

In a further preferred embodiment, the image-erasing apparatus may further comprise a substance treating unit, disposed outside the case at a portion adjacent to the air outlet formed to the case for decomposing and then adsorbing a substance generated at a time of heating and erasing the image formed on the medium.

In this preferred embodiment, the substance treating unit may include a photo-catalyst carrier carrying a photo-catalyst, at least one pair of voltage terminals for applying voltage to the photo-catalyst carrier disposed between the paired voltage terminals, and a power source for supplying a power to the voltage terminals.

An ozone treating device may be disposed for decomposing an ozone generated by the discharge between the paired terminals. The ozone treating device and the photo-catalyst carrier may be integrated as a unit.

In an alternation, the substance treating unit and the heating unit may be synchronously operated.

The substance decomposing unit may further include an adsorption device for adsorbing the substance generated at the time of heating and erasing the image formed on the medium.

The substance treating unit may be disposed inside the case at a portion adjacent to the air outlet formed to the case for decomposing and then adsorbing a substance generated at a time of heating and erasing the image formed on the medium.

In another aspect of the present invention, there is also provided a method of erasing an image formed on a medium with an image-erasable material comprising the steps of:

preparing a heating unit and putting a medium on the heating unit; and heating the heating unit so as to heat the medium at a predetermined temperature.

The image-erasing method may further include the steps of preparing a substance treating unit including a photo-catalyst on a downstream side of the heating unit and decomposing, through a photo-catalyst reaction, an odor component contained in the substance and generated during the heating step.

The image-erasing method may further include the step of adsorbing a substance generated in the heating step by a substance adsorption device disposed for the substance treating unit.

According to the present invention of the aspects mentioned above, a large installation space is not required, and no harmful substance is generated, thus being suitable for use in an enclosed area such as an office.

In addition, according to the preferred embodiment of the present invention, there is less consumption of electric power. An odor component which may be contained in the substance generated during the heating process can be effectively removed by the location of the substance treating unit, thus being advantageous and convenient.

The nature and further characteristic features of the present invention will be made more clear from the following descriptions with reference to the accompanying drawings.

DESCRIPTION OF THE PREFERRED EMBODIMENTS

The image-erasing apparatus according to the present invention will be described hereunder with reference to the accompanying drawings.

First Embodiment 1

Figure 1:
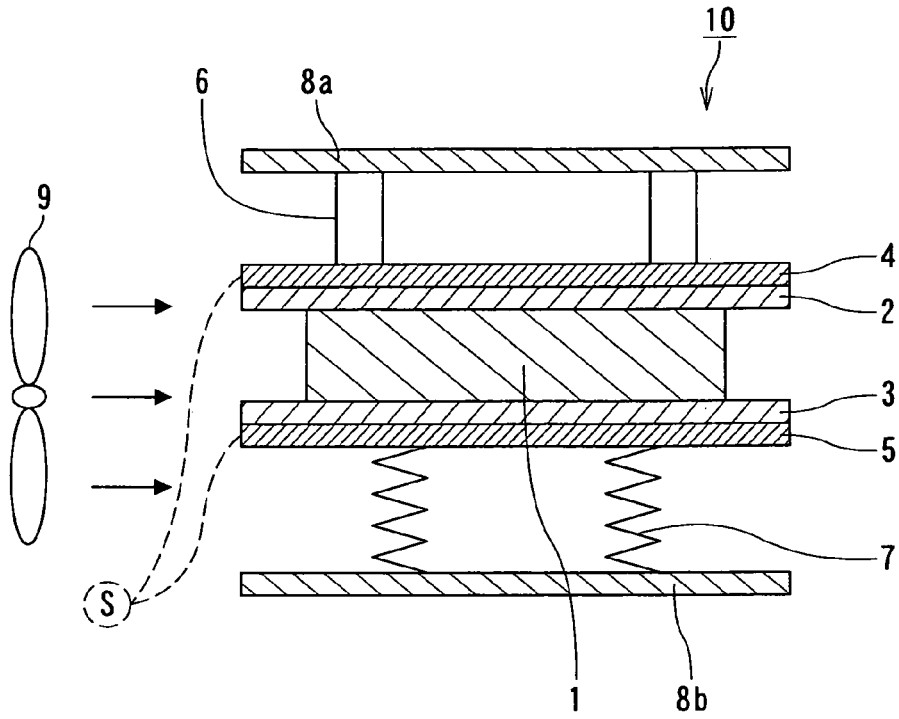
FIG. 1 is a sectional view showing a structure of the image-erasing apparatus according to a first embodiment 1 of the present invention.

The image-erasing apparatus according to the first embodiment 1 will now be described with reference to FIGS. 1 and 2.

An image-erasing apparatus 10 of this first embodiment is one usable alongside a printer or a copying machine in an office or like. This image-erasing apparatus 10 is comparatively compact, power-saving, and has high-efficiency.

A bundle of sheets of paper 1 is sandwiched between two heating plates 2 and 3. On each sheet of paper, an image is formed with an erasable image-forming material. The heating plates 2 and 3 are provided with plate-shaped electric heaters 4 and 5, respectively, which are electrically connected to a power source S. Thus, a heating unit is composed of the heating plates 2 and 3 and the electric heaters 4 and 5.

The electric heater 4 is connected to a heat-blocking plate 8*a* via spacers 6. The electric heater 5 is connected to a heat-blocking plate 8*b* via an elastic member 7 such as spring(s) in this embodiment. In order to cool the heated portions or parts, a blower fan 9 functioning as a cooling device is provided. The blower fan 9 sends air to the heated portions so as to regulate the temperature.

The heating plates 2 and 3 are made of metal, preferably, of a highly heat-conductive material such as aluminum or copper. The spacers 6 are preferably made of highly heat-insulating materials such as ceramics or FRP. The heat-blocking plates 8*a* and 8*b* are made of metal, and are preferably mirror-polished or mirror-coated. In consideration of office use, the heating plates 2 and 3 have a size suitable for A4 sheets of paper or a size suitable for A3 sheets of paper. Further, it may be preferred that the heating plates 2 and 3 have a size suitable for A3 size paper because the heating plates 2 and 3 also usable for A4 size paper.

The operation of the image-erasing apparatus 10 of the first embodiment 1 will be explained hereunder.

First, a bundle of sheets of paper 1 is placed between a pair of heating plates 2 and 3. While being urged by the elastic member 7, the heating plate 3 presses the paper bundle 1. The paper bundle 1 comes into contact with the heating plates 2 and 3 at its front and back surfaces. Heat conduction from the heating plates 2 and 3 to the paper bundle 1 is reliably maintained. Since the heating plates 2 and 3 are made of a highly heat-conductive material such as aluminum and copper, the surface temperature of the heating plates 2 and 3 is uniform, and therefore, the bundle of sheets of paper 1 can be heated uniformly, and as a result of this heat conduction, images formed on the sheets of paper are erased at a predetermined temperature.

Since the heating plates 2 and 3 are made of a highly heat-conductive material, the surfaces of the heating plates 2 and 3 are evenly heated without requiring uniform arrangement of the electric heaters 4 and 5. Therefore, the selections or choices of the electric heaters 4 and 5 can be made widely. When heating is performed, heat is radiated from the heating plates 2 and 3 and the electric heaters 4 and 5. However, in the image-erasing apparatus 10, the radiated heat is reflected by the heat-blocking plates 8*a* and 8*b*. Therefore, the heating efficiency is improved. If the heat-blocking plates 8*a* and 8*b* are mirror-polished or mirror-coated, the heating efficiency could be further improved.

However, improving heat conductivity and preventing heat radiation may deteriorate the cooling characteristics, which requires a long time to perform cooling-down. When performing cooling-down after heating, in the image-erasing apparatus 10, a flower fan 9 blows external air on the bundle of sheets of paper 1, the heating plates 2 and 3, the electric heaters 4 and 5, and the heat-blocking plates 8*a* and 8*b*, thereby effectively performing cooling-down through a forced convection. Therefore, the cooling-down time after heating can be shortened, thus being effective.

Figure 2:
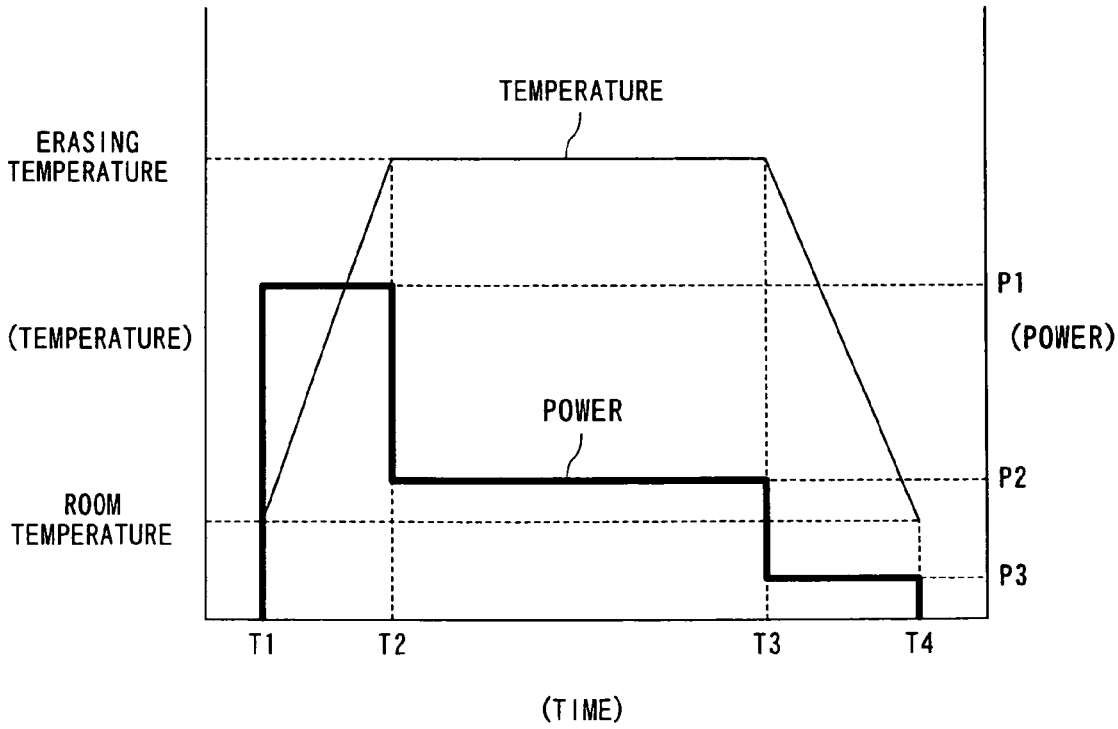
FIG. 2 is a diagram showing temperature changes and power consumption in an operating pattern of the image-erasing apparatus according to the first embodiment shown in FIG. 1 of the present invention.

FIG. 2 shows an operating pattern of the image-erasing apparatus according to the first embodiment 1 of the present invention having the structure mentioned above.

With reference to FIG. 2, first, at a time T1, the temperature starts to increase. At a time T2, the temperature reaches the predetermined erasing temperature. The erasing temperature is maintained until a time T3. At the time T3, the cooling-down starts. At a time T4, the temperature returns to the room temperature.

The erasable image-forming material develops color through an interaction between a color former and a developer included in the material. When the image-forming material is heated, the color former preferentially dissolves with a binder resin in the material so that the material loses color. In the case where a decolorizer is used, the decolorizer reacts with the developer so that the material loses color. The higher the temperature, the more quickly the reaction proceeds. However, if the temperature is too high, the paper burns and becomes discolored. In consideration of the erasing performance and the prevention of burning the paper, the erasing temperature is preferably 120° C. to 150° C. Thus, the image can be erased by maintaining the temperature in this range for a few hours. In the case where the erasing temperature is maintained in the range of 120° C. to 150° C., the time required for the erasing is approximately an hour and a half to two hours.

The power consumption required for the erasing is highest (P1) when the temperature increases. After the temperature reaches the erasing temperature and when the erasing temperature is maintained, the power consumption required is reduced to P2 because the power is used only to compensate the heat loss due to the heat radiation. In the cooling process, the power consumption required is further reduced to P3 because the power is used only for the operation of the blower fan 9. Therefore, the average power consumption required for erasing images is reduced. According to experiments conducted by the inventors, when the temperature increased for 30 minutes, and 500 sheets of A4 paper were processed, the maximum power consumption P1 ranged from 1 kW to 1.5 kW. Therefore, the image-erasing apparatus 10 can be used in an office having a 100V AC power supply.

In the case where the heating plates 2 and 3 have a size suitable for A3 sheets of paper, two bundles of A4 paper can be processed. The thickness of two paper bundles is half the thickness of a bundle in the case where the heating plates 2 and 3 have a size suitable for A4 sheets of paper. The smaller the distance between the heating plates 2 and 3, the more uniform the temperature of the space between the heating plates 2 and 3, thus further saving the power.

The image-erasing apparatus 10 of this embodiment includes: the two heating plates 2 and 3 sandwiching a paper bundle 1 therebetween, the heating plates 2 and 3 having the size being suitable for A4 or A3; the electric heaters 4 and 5 serving as heating devices; the heat-blocking plates 8*a* and 8*b* for improving heating efficiency; and the blower fan 9 for shortening the cooling time, thereby realizing the apparatus 10 having compact size or dimension. In addition, the average power consumption of the apparatus 10 is low, and the maximum power consumption thereof is also low. Therefore, the apparatus 10 can be easily installed in an office.

Second Embodiment 2

The image-erasing apparatus according to the second embodiment 2 will be described hereunder with reference to FIG. 3. In the following description of this second embodiment 2, the same reference numerals are used to designate the same components as those in the first embodiment 1, and therefore, the detailed description thereof is omitted herein.

In an image-erasing apparatus 20 of this second embodiment, a bundle of sheets of paper 1 is contained in a metal tray 21 in a rested state thereon so that the metal tray 21 is disposed between the two heating plates 2 and 3.

The metal tray 21 is preferably made of a highly heat-conductive material such as aluminum or copper. The paper bundle 1 is sandwiched between the two heating plates 2 and 3. The heating plates 2 and 3 are provided with the plate-shaped electric heaters 4 and 5, respectively, functioning as heating unit connected to the power source S. The electric heater 4 is connected to the heat-blocking plate 8*a* via spacers 6. The electric heater 5 is connected to the heat-blocking plate 8*b* via the elastic member 7 such as springs. In order to cool the heated portions or parts after heating, the blower fan 9 functioning as a cooling device is provided. The blower fan 9 sends air to the heated portions so as to regulate the temperature.

In the image-erasing apparatus 20 of this second embodiment, the paper bundle 1 is surrounded by the metal tray 21, and heat is conducted from the heating plate 3 to the metal tray 21. Since the metal tray 21 is made of a highly heat-conductive material, the temperature of the metal tray 21 becomes uniform of approximately the same temperature as that of the heating plate 3. Therefore, the top and bottom of the paper bundle 1 are heated by the heating plates 2 and 3, respectively. Furthermore, since the sides of the paper bundle 1 are heated by the side walls of the tray 21, the heating efficiency can be improved, and the power required for the heating is reduced. In addition, since the temperature of the paper bundle 1 is made uniform, the image-erasing characteristics can be improved.

Still furthermore, since the bundle of sheets of paper 1 is contained in the metal tray 21, the bundle of sheets of paper 1 can be simply and easily transferred to and from the image-erasing apparatus 20.

In the image-erasing apparatus 20 of this second embodiment, as mentioned above, a bundle of sheets of paper 1 is contained in a metal tray 21, which is disposed between the two heating plates 2 and 3, so that the average power consumption and the maximum power consumption can be reduced. In addition, it is simple to transfer the paper bundle 1 into and from the image-erasing apparatus 20.

Third Embodiment 3

Figure 4:
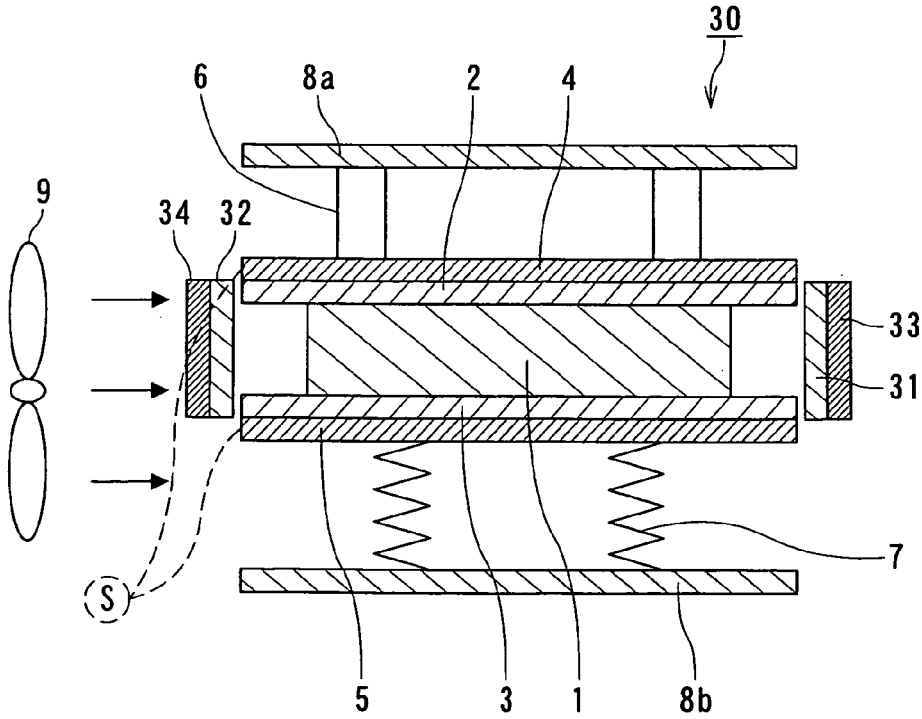
FIG. 4 is a sectional view showing a structure of the image-erasing apparatus according to a third embodiment 3 of the present invention.

The image-erasing apparatus 30 according to the third embodiment 3 will now be described hereunder with reference to FIG. 4. In the description of this third embodiment, the same reference numerals are added to the same components as those in the first and second embodiments and the description thereof is hence made short or omitted herein.

In the image-erasing apparatus 30 of this embodiment, a bundle of sheets of paper 1 is heated in a state of being surrounded on four sides by four heating plates 2, 3, 31 and 32.

The heating plates 2, 3, 31 and 32 are provided with electric heaters 4, 5, 33 and 34, respectively, functioning as heating unit. The electric heater 4 is connected to the heat-blocking plate 8*a* via the spacers 6. The electric heater 5 is connected to the heat-blocking plate 8*b* via an elastic member 7 such as springs as shown. In order to cool the heated portions or parts after heating, the blower fan 9 functioning as a cooling device is provided. The blower fan 9 sends air to the heated portions so as to regulate the temperature.

In the image-erasing apparatus 30 of this embodiment, a bundle of sheets of paper 1 is surrounded by the heating plates 31 and 32 in addition to the plates 2 and 3. Therefore, the heating characteristics and the uniformity of the heating temperature of the paper bundle 1 can be further improved.

Furthermore, although, in this embodiment, two side-surfaces of the bundle of sheets of paper 1 are provided with the heating plates 31 and 32, it may be possible to further arrange two heating plates so as to surround the four side-surfaces of the bundle of sheets of paper 1. In such arrangement, the paper bundle 1 is heated from six directions in total.

Fourth Embodiment 4

Figure 5:
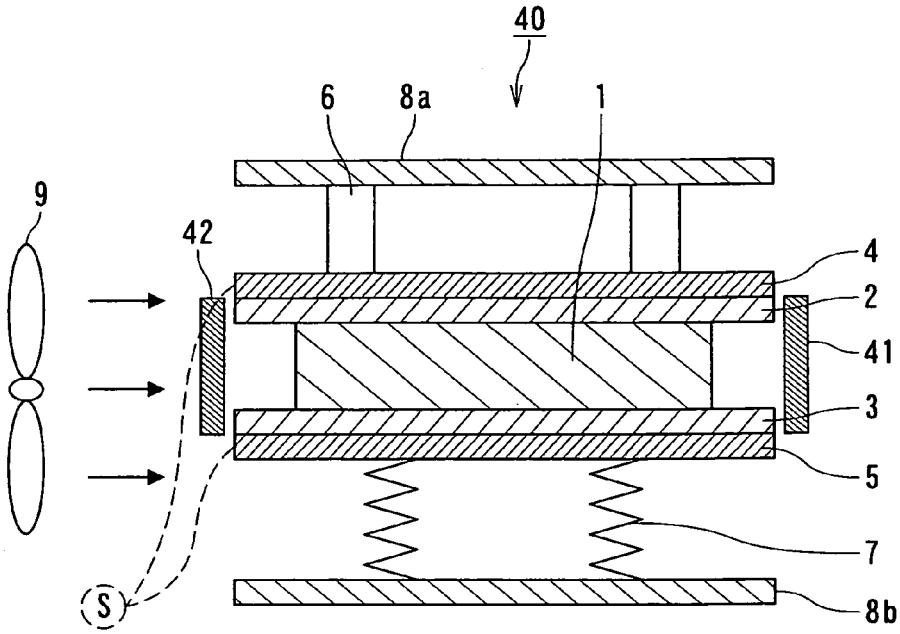
FIG. 5 is a sectional view showing a structure of the image-erasing apparatus according to a fourth embodiment 4 of the present invention.

The image-erasing apparatus according to the fourth embodiment 4 will now be described hereunder with reference to FIG. 5. In the description of this fourth embodiment, the same reference numerals are added to the same components as those in the former embodiments 1 to 3, and the description thereof is made short or omitted herein.

In the image-erasing apparatus 40 of this fourth embodiment, a bundle of sheets of paper 1 is surrounded by the two heating plates 2 and 3 and two heat-reflecting plates 41 and 42.

The heating plates 2 and 3 are provided with the electric heaters 4 and 5, respectively, functioning as heating unit. The electric heater 4 is connected to the heat-blocking plate 8*a* via the spacers 6. The electric heater 5 is connected to the heat-blocking plate 8*b* via the elastic member 7 such as springs. In order to cool the heated portions or parts after heating, the blower fan 9 functioning as a cooling device is provided. The blower fan 9 sends air to the heated portions so as to regulate the temperature.

In the image-erasing apparatus 40 of this fourth embodiment, the heat radiated from the heating plates 2 and 3 is reflected by the heat-reflecting plates 41 and 42. Therefore, the heating can be performed more efficiently and uniformly.

In this embodiment, although the two heat-reflecting plates 41 and 42 are additionally provided on two sides of the paper bundle 1, it will be apparent that further two heat reflecting plates may be arranged so as to surround the paper bundle 1 from the four directions.

Fifth Embodiment 5

Figure 6:
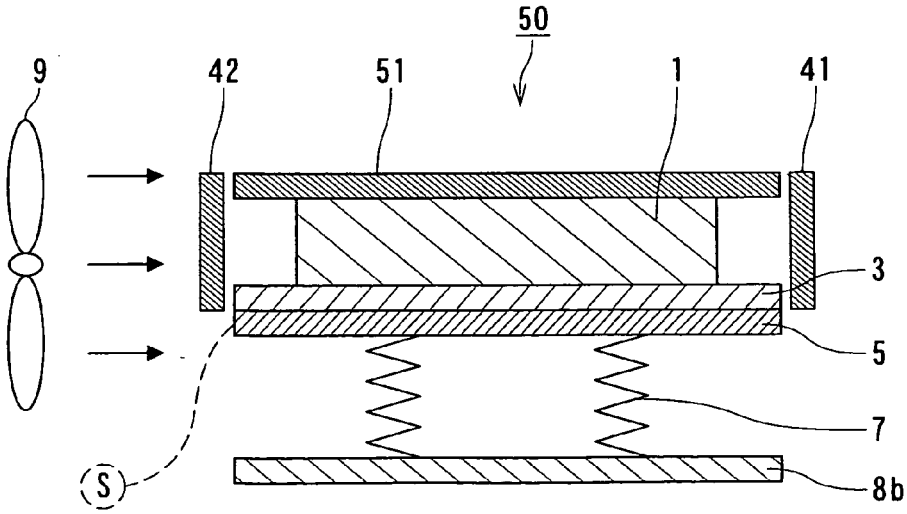
FIG. 6 is a sectional view showing a structure of the image-erasing apparatus according to fifth embodiment 5 of the present invention.

The image-erasing apparatus 50 according to the fifth embodiment 5 will now be described hereunder with reference to FIG. 6. In the description of this fifth embodiment, the same reference numerals are added to the same components as those in the former embodiments 1 to 4, and the description thereof is made short or omitted herein.

In the image-erasing apparatus 50 of this fifth embodiment, a bundle of sheets of paper 1 is surrounded by a single heating plate 3 and heat-reflecting plates 41, 42, and 51. That is, the heating plate 2 in the former embodiments is removed.

The heating plate 3 are provided with the electric heater 5 functioning as a heating unit. The electric heater 5 is connected to the heat-blocking plate 8*b* via the elastic member 7 such as springs as shown. In order to cool the heated portions or parts after heating, the blower fan 9 functioning as a cooling device is provided. The blower fan 9 sends air to the heated portions so as to regulate the temperature.

In the image-erasing apparatus 50 of this fifth embodiment, since the paper bundle 1 is surrounded by the heating plate 3 and the heat-reflecting plates 41, 42, and 51, the heating can be uniformly performed. In addition, since the heating unit is composed of only the single heating plate 3 and heater 5, production cost and weight of the entire apparatus can be reduced.

In this fifth embodiment, further two reflecting plates may be arranged in addition to the vertical heat-reflecting plates 41 and 42 so as to surround the bundle of sheets of paper 1 from four sides thereof.

Sixth Embodiment 6

The image-erasing apparatus 60 according to the sixth embodiment 6 will now be described hereunder with reference to FIG. 7. In the description of this sixth embodiment, the same reference numerals are added to the same components as those in the former embodiments 1 to 5, and the description thereof is therefore made short or omitted herein.

Figure 3:
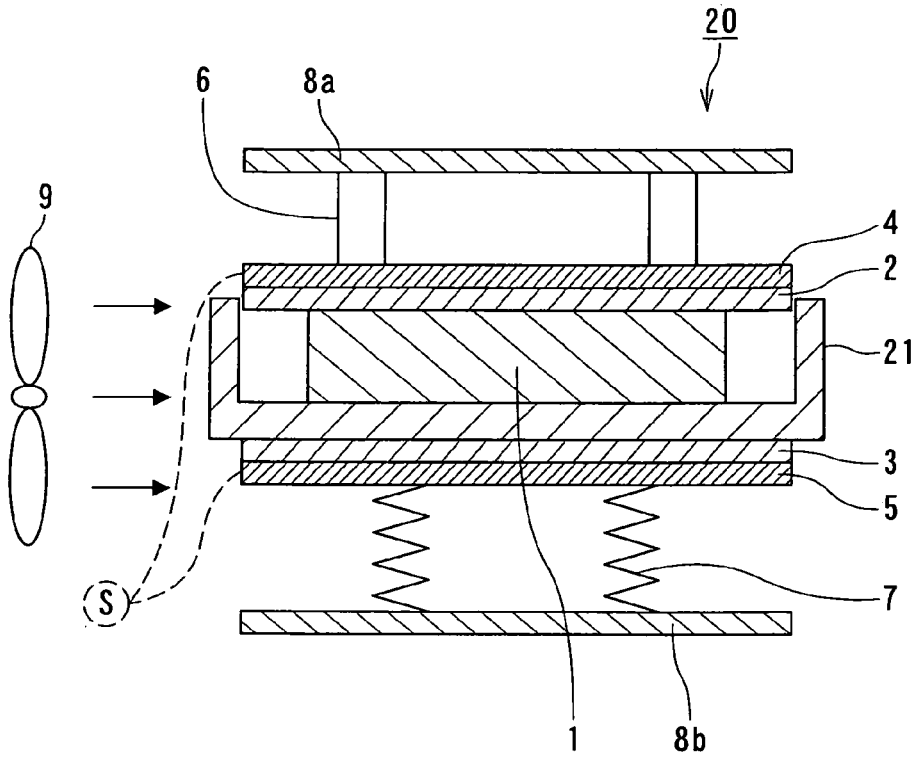
FIG. 3 is a sectional view showing a structure of the image-erasing apparatus according to a second embodiment 2 of the present invention.

In the image-erasing apparatus 60 of this sixth embodiment, the image-erasing apparatus 20 of the second embodiment 2 is contained in a case 60*a* which surrounds the structure of the second embodiment 2 of FIG. 3, for example.

As in the second embodiment, the bundle of sheets of paper 1 is sandwiched between the two heating plates 2 and 3. The heating plates 2 and 3 are provided with the electric heaters 4 and 5, respectively, functioning as heating unit. The electric heater 4 is connected to the heat-blocking plate 8*a* via the spacers 6. The electric heater 5 is connected to the heat-blocking plate 8*b* via the elastic member 7 such as springs as shown. In order to cool the heated portions or parts, the blower fan 9 functioning as a cooling device is provided. The blower fan 9 sends air to the heated portions so as to regulate the temperature.

In this sixth embodiment, the case 60*a* is composed of an upper part (section) 61 and a lower part (section) 62 to be opened or detachable form each other, and the case 60*a* has a vent for the escape of heat. The vent may includes an air inlet 30*a* through which an external air is introduced into the case 60*a* by the operation of the fan 9 and an air outlet 30*b* through which the heated air is discharged outside the case 60*a*. In a preferred embodiment, such inlet and outlet 30*a* and 30*b* may be formed as slits. The case 60*a* is insulated with air from the heating plates 2 and 3 and the metal tray 21. It may be preferable to dispose an insulating member therebetween in order to reduce heat transfer to the case. A handle 63 may be provided for at least one of the upper part 61 and lower part 62 of the case 60*a* in order to improve portability and carry the case to another portion.

In the image-erasing apparatus 60 of this sixth embodiment, when the electric heaters 4 and 5 are heated at a high temperature, burn injury due to the touching of an operator to the heating plates 2 and 3 and the metal tray 21 can be prevented, thus improving the safety of the image-erasing apparatus 60.

The entire structure of the apparatus in the case 60*a* may be supported therein in a suspended manner from an inner upper portion of the case 60*a* or may be fixed to the bottom thereof.

It is of course to be noted that although the structure or arrangement of the second embodiment of FIG. 3 is utilized for this sixth embodiment, this structure is substituted with the other embodiments 1 and 3 to 5.

Seventh Embodiment 7

Figure 8:
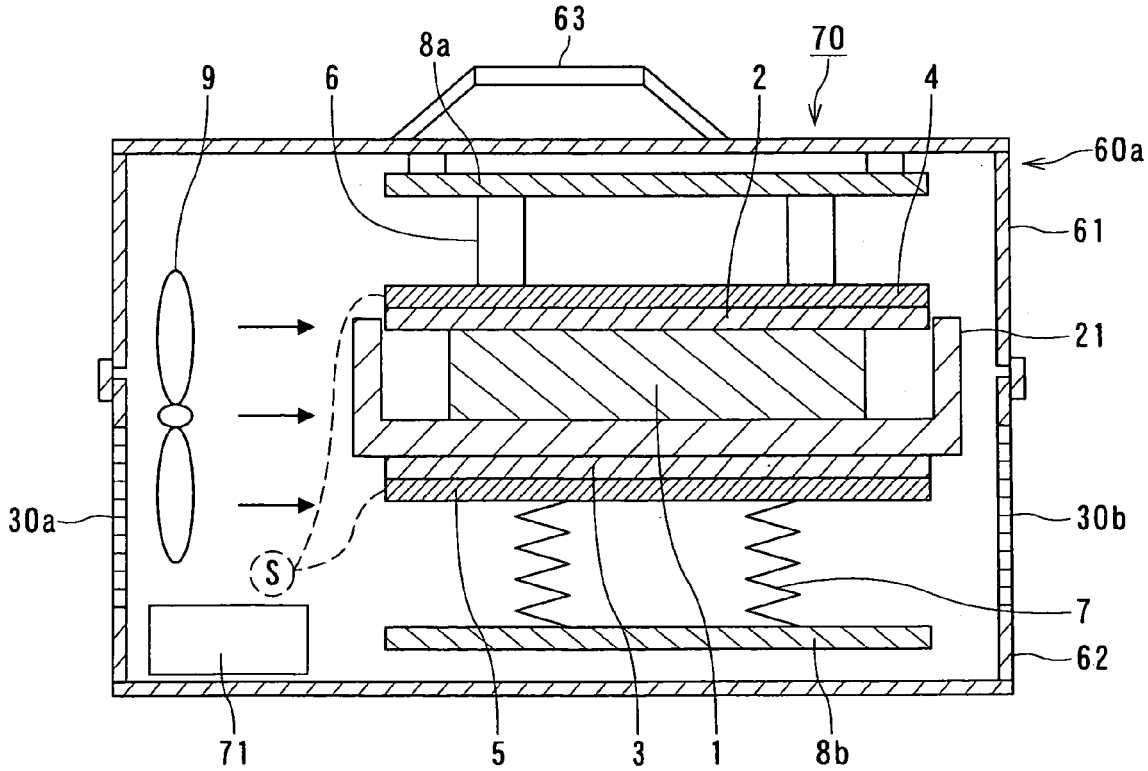
FIG. 8 is a sectional view showing a structure of the image-erasing apparatus according to a seventh embodiment 7 of the present invention.

The image-erasing apparatus 70 according to the seventh embodiment 7 will now be described hereunder with reference to FIG. 8. In the description of this seventh embodiment, the same reference numerals are added to the same components as those in the former embodiments 1 to 6, particularly of the embodiment 6, and the description thereof is therefore made short or omitted herein.

The image-erasing apparatus 70 of this seventh embodiment has a control unit 71, which is installed in the case 60*a*, for controlling the temperature and time required for heating the paper bundle 1 by the electric heating unit. The control unit 71 automatically controls the cooling start time and the time required for the cooling by blowing air. In addition, the control unit 71 has an interlocking mechanism for safety.

Figure 7:
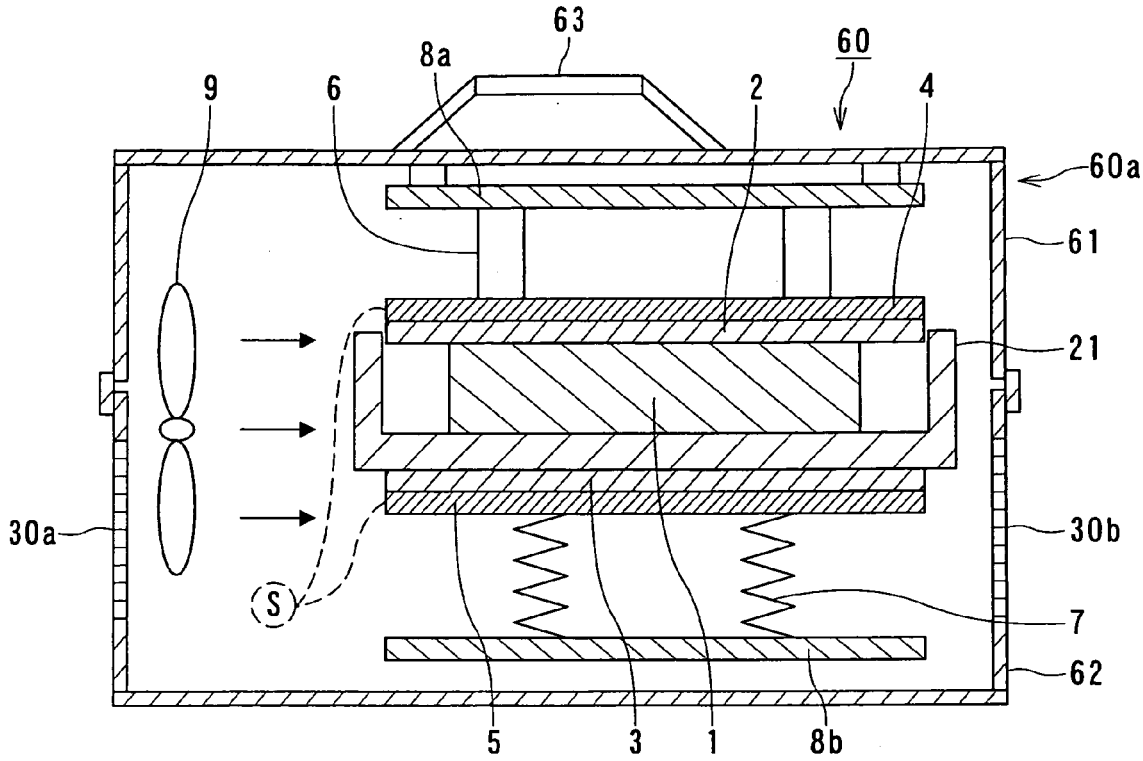
FIG. 7 is a sectional view showing a structure of the image-erasing apparatus according to a sixth embodiment 6 of the present invention.

In the image-erasing apparatus 70 of this seventh embodiment, the control unit 71 is installed in addition to the apparatus 60 of FIG. 7, so that the safety of the image-erasing apparatus can be further improved. In addition, the erasing efficiency can be also improved, and therefore, average power consumption and the maximum power consumption are further reduced.

Eighth Embodiment 8

Figure 9:
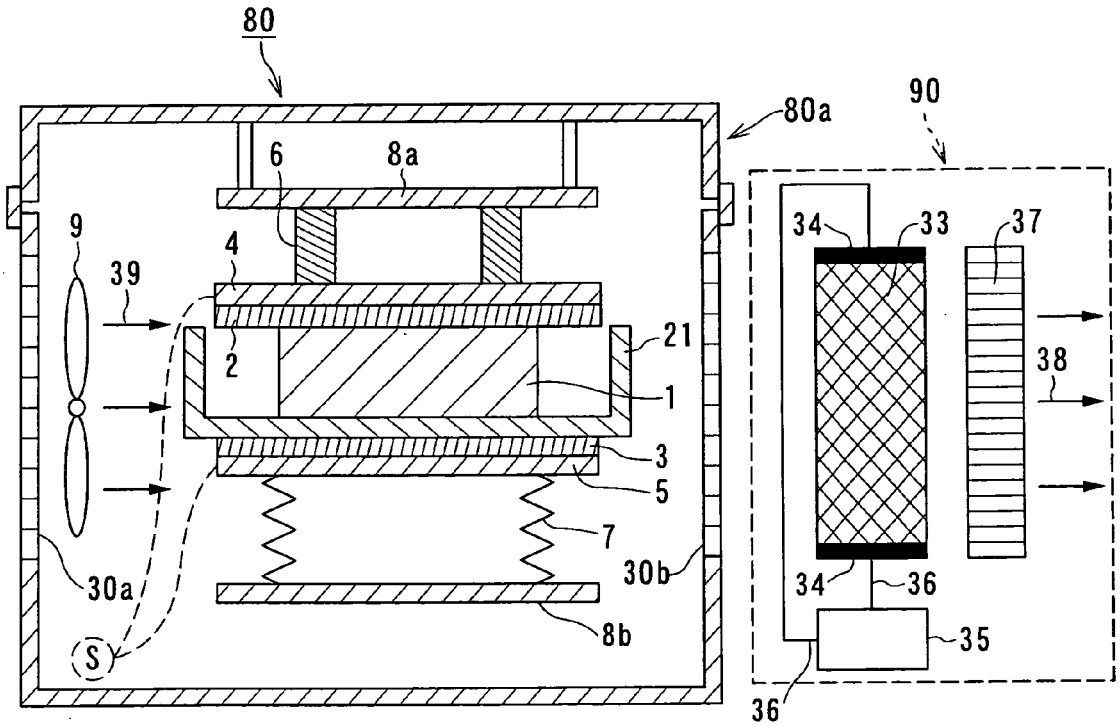
FIG. 9 is a sectional view showing a structure of an image-erasing apparatus for erasing image-forming material according to another, i.e., eighth, embodiment of the present invention.

FIG. 9 represents a further embodiment, as eighth embodiment 8, of an image-erasing apparatus of the present invention, in which the same reference numerals are added to the same components as those in the former embodiments 1 to 7, and the description thereof is therefore made short or omitted herein.

The image-erasing apparatus 80 of this eighth embodiment has an arrangement different from the arrangements of the former embodiments 1 to 7 in an additional location of a substance treating device or unit. Accordingly, although, in FIG. 9, an apparatus, substantially identical to the image-erasing apparatus 20 of the second embodiment 2, is accommodated in an outer case 80*a*, the apparatus 20 may be substituted with the other apparatus of the embodiments shown in FIG. 1 and FIGS. 4 to 8.

As mentioned above, in this eighth embodiment, a structure or arrangement for removing an undesirable substance or component such as odor is additionally provided as a substance treating unit 90.

With reference to FIG. 9, the image-erasing apparatus 80 of this eighth embodiment includes a heating unit for heating a bundle of sheets of paper 1. On each sheet of paper, an image is formed with an erasable image-forming material. The heating unit includes a pair of heating plates 2 and 3, electric heaters 4 and 5 for supplying heat to the heating plates 2 and 3, respectively, and a metal tray 21.

As mentioned above with reference to the second and sixth embodiments, in the image-erasing apparatus of this eighth embodiment, the paper bundle 1 is rested in the metal tray 21 and heated by the heating plates 2 and 3 from two directions. The metal tray 21 is preferably made of a highly heat-conductive material such as aluminum or copper. The heating plates 2 and 3 are provided with plate-shaped electric heaters 4 and 5, respectively. One electric heater 4 is connected to a heat-blocking plate 8*a* via spacers 6, and on the other hand, the other electric heater 5 is connected to another heat-blocking plate 8*b* via the elastic member 7. The heat-blocking plates 8*a* and 8*b* block the heat radiated from the electric heaters 4 and 5. In addition, the image-erasing apparatus 80 is provided with a blower fan 9.

These structures or arrangements are substantially the same as those of FIG. 3 or FIG. 7.

The heating plates 2*a* and 2*b* are preferably made of a highly heat-conductive material such as aluminum or copper. For the elastic member 7, although a spring having an appropriate spring constant is utilized, a heat-resistant rubber or a heat-resistant sponge may be substituted therefor. The spacer 6 is preferably made of highly heat-insulating materials such as ceramics or fiber-reinforced plastic (FRP). The heat-blocking plates 8*a* and 8*b* are made of metal. It is desirable that their surfaces are mirror-polished or mirror-coated.

The size of the tray 21 may be determined according to the size of the sheets of paper to be processed as mentioned hereinbefore in consideration of the office use.

In the image-erasing apparatus 80 of this eighth embodiment, the case 80*a* is formed with vent ports or holes as air inlet 30*a* and air outlet 30*b*, which are preferably formed as slits, for example, through which the air is introduced inside the case 80*a* by the operation of the fun 9 to cool the respective elements or members of the apparatus 80 and then is discharged outside the case 80*a*.

The substance treating unit 90 functions as a decomposing device and is arranged outside the case 80*a* at a portion directly outside the vent port 30*b*. The substance treating unit 90 has a function for removing the substances produced in the erasing process and acts to decompose odor or odorous substances produced during the heating process of the recording media. The substance treating unit 90 includes a photo-catalyst carrier 33, a pair of voltage terminals 34, and a power supply 35. The photo-catalyst carrier 33 is disposed between the voltage terminals 34. The voltage terminals 34 are supplied with power from the power supply 35 via wires 36.

Due to the electric discharge between the voltage terminals 34, oxygen in the air reacts to generate ozone. Due to the oxidizing properties of the ozone, the odorous substances, i.e., organic matter, are oxidized and decomposed. In this process, however, since the ozone itself also has an odor, it is necessary to remove the excess ozone not used for the decomposition.

Therefore, an ozone-removing device 37 is further arranged downstream side the photo-catalyst carrier 33. The ozone-removing device 37 uses, for example, activated carbon or an ozone-decomposing catalyst.

Some of the substances produced during the heating of the recording media may be suitable for adsorption, and in such-case, in order to adsorb the substances, an adsorbing device such as a filter may be provided, or alternatively, an additional function may be added to the existing image-erasing apparatus 80.

The image-erasing apparatus 80 including the substance treating unit 90 of this eighth embodiment will be operated as follows.

A bundle of sheets of paper 1 is placed in the tray 21, and while being urged by the elastic member 7 such as springs, the paper bundle 1 contacts the upper heating plate 2 and the lower heating plate 3 contacts the tray 21. Since the tray 21 is highly heat-conductive, the heat conduction from the heating plates 2 and 3 to the paper bundle 1 is reliably maintained. Since the heating plates 2 and 3 are made of a highly heat-conductive material such as aluminum and copper, the surface temperature of the heating plates 2 and 3 can be made uniform, and the paper bundle 1 can be hence heated uniformly. As a result of this heat conduction, images formed on the paper are erased.

In the cooling process, the blower fan 9 sends air 39 to cool the heating unit.

According to this embodiment, the odor or odorous substances produced in the erasing process are carried downstream side with the flow of the air 39 to the substance treating unit 90. The odor substances are decomposed by the photo-catalyst carried by the photo-catalyst carrier 33. The air is then fed to the ozone-removing device 37 and then discharged outward as discharged air 38.

Figure 10:
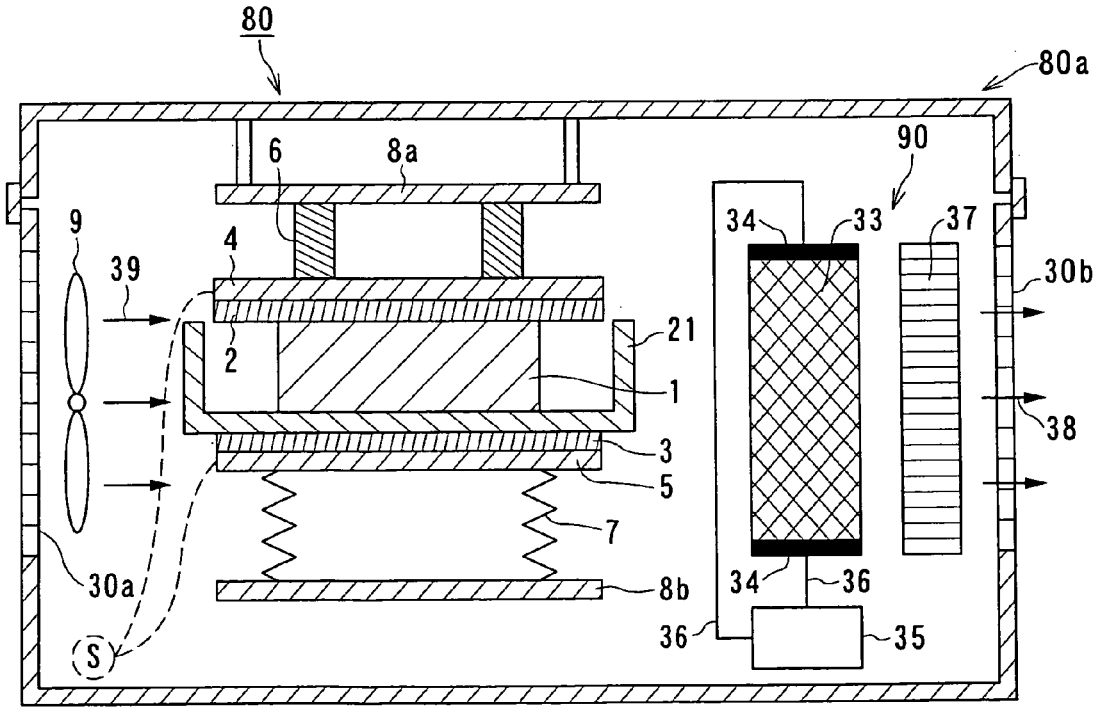
FIG. 10 is a sectional view showing a structure of an image-erasing apparatus for erasing image-forming material according to a modification of the eighth, embodiment of the present invention.

In an alternation of the above eighth embodiment, as shown in FIG. 10, the substance treating unit 90, as odor substance decomposing device, including the ozone-removing device 37, may be disposed inside the case 80*a* at a portion between the metal tray 21 of the main arrangement of the apparatus and the vent (outlet) port 30*b* formed to the case 80*a*.

Other than the location of the substance treating unit 90 inside the case 80*a*, the apparatus of FIG. 10 is substantially identical to that of FIG. 9, except that the substance treating unit 90 of FIG. 9 is accommodated in a case as a single unit.

Figure 11:
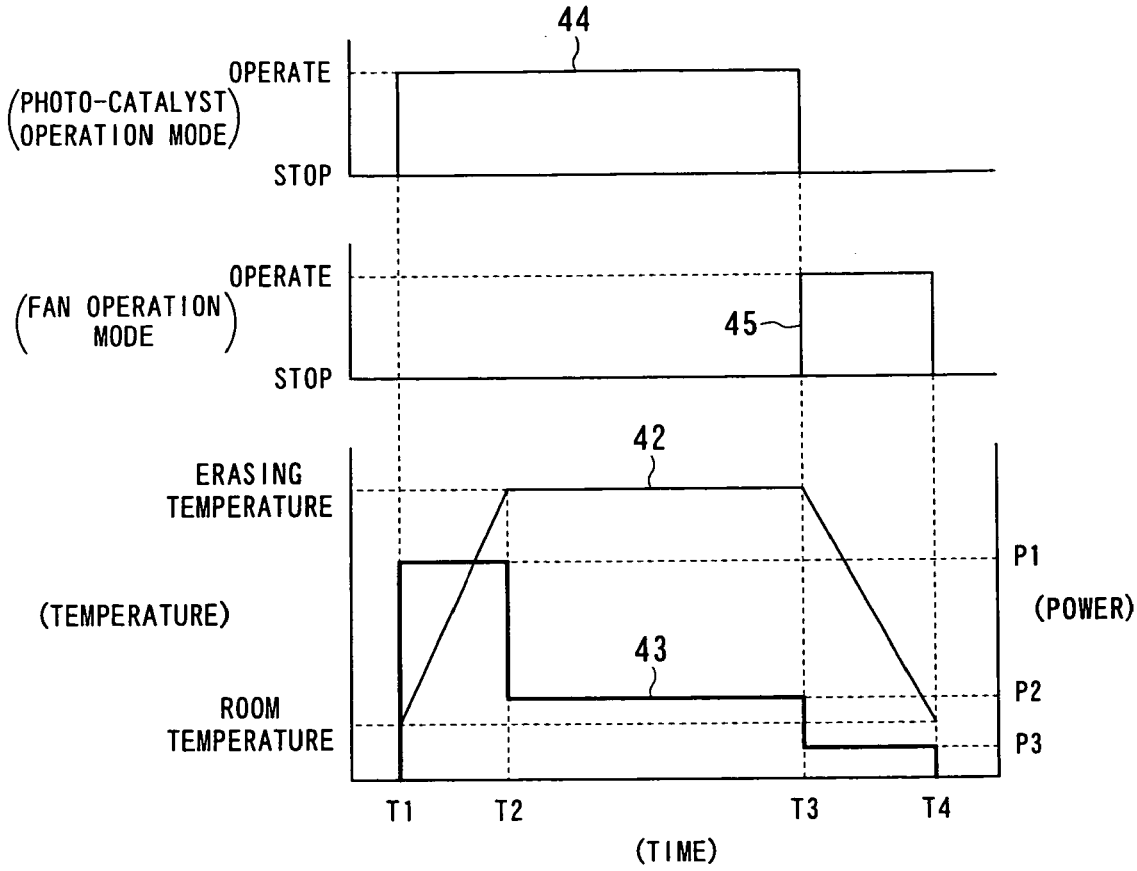
FIG. 11 is a diagram showing an operating pattern of the image-erasing apparatus according to the eighth embodiment.

FIG. 11 shows an operation pattern or mode in the image-erasing apparatus 80 of this eighth embodiment. The lower diagram (graph) of FIG. 11 shows the change in temperature and power with time. The vertical axis on the left side represents temperature, and the vertical axis on the right side represents power.

The line 42 shows temperature changes in the image-erasing apparatus 80. First, at a time T1, the electric heaters 4 and 5 are activated, and the temperature starts to increase. At a time T2, the temperature reaches the erasing temperature. The erasing temperature is maintained until a time T3. At the time T3, the cooling down starts. At a time T4, the temperature returns to the room temperature.

The erasable material develops color through the interaction between a color former and a developer included in the material. When the image-forming material is heated, the color former preferentially dissolves with a binder resin in the material so that the material loses color. In the case where a decolorizer is used, the decolorizer reacts with the developer so that the material loses color. The higher the temperature, the more quickly the reaction proceeds. However, if the temperature is too high, the paper will burn and become discolored. In consideration of the erasing performance and the prevention of burning of the paper, the erasing temperature is preferably 120° C. to 150° C. By maintaining a temperature in this range for a few hours, the images can be substantially erased. According to experiments conducted by the inventors, in the case where the erasing temperature is maintained in the range of 120° C. to 150° C., the time required for erasing was approximately an hour and a half to two hours.

The line 43 shows power consumption of the image-erasing apparatus 80. As shown in FIG. 11, when the temperature increases, the power consumption is highest (P1). After the temperature reaches the erasing temperature and when the erasing temperature is maintained, the power consumption is reduced to P2 because the power is used only to compensate the heat loss due to the heat radiation. In the cooling process, the power to be consumed is further reduced to P3 because the power is used only for the operation of the blower fan 9.

The upper diagram (graph) of FIG. 11 shows an operation of the photo catalyst. The middle diagram (graph) of FIG. 11 shows the operation of the blower fan 9. As shown with lines 44 and 45, in the temperature-increasing process (time T1 to time T2) and the erasing process (time T2 to time T3), the blower fan 9 is stopped so as to increase the heating efficiency, and the photo-catalyst is operated to decompose the odor substances. In the cooling process (time T3 to time T4), the operation of the photo-catalyst is stopped, and the blower fan 7 is driven.

In the image-erasing apparatus 80, the bundle of sheets of paper 1 is surrounded by the tray 21 and heating plates 2 and 3. In addition, these are sandwiched between the heat-blocking plates 8*a* and 8*b* so as to prevent heat radiation. The electric heaters 4 and 5 are supported by spacers 6 and the elastic member 7, i.e., springs, respectively. Since the spacers 6 and the elastic member 7 have a low heat-transfer coefficient, the heat radiation from these supporting parts can also be prevented. The above-described structure reduces the average power consumption of the image-erasing apparatus 80, and the image-erasing apparatus 80 can be manufactured at a low cost.

According to experiments conducted by the inventors, when the temperature increased for 30 minutes, and 500 sheets of A4 paper were processed, the maximum power consumption P1 ranged from 1 kW to 1.5 kW. Therefore, the image-erasing apparatus 80 can be used in an office having a 100V AC power supply.

The deodorizing mechanism according to the image-erasing apparatus 80 of the eighth embodiment and the alternation thereof will be described hereunder.

In the erasing apparatus 80, when the heating of the paper bundle 1 is started at the time T1 in FIG. 11, odor substances are generated or produced. It is therefore desirable to synchronize the operation of the substance treating unit 90 with that of the heating unit.

When the paper bundle 1 is heated by the heating unit, chemicals contained in the paper bundle 1 evaporate, diffuse, and flow towards the vent port, i.e., outlet port 30*b*. At the time T1, the power supply 35 of the substance treating unit 90 is operated so as to excite the voltage terminals 34 to thereby generate the electric discharge. Due to this electric discharge, a creeping discharge is generated on the surface of the photo catalyst carrier 33 between the voltage terminals 44. Due to this creeping discharge, ultraviolet radiation is emitted. As a result of being irradiated with this ultraviolet radiation, the photo-catalyst in the photo-catalyst carrier 33 is activated. According to the reaction of the photo-catalyst, the odor substances produced during the heating of the paper bundle 1 are decomposed.

The inventors compared the case where the photo-catalyst was activated with the case where the photo-catalyst was not activated. In each case, an odor index at the vent port was measured. Table 1 shows the measurement results of the odor index.

The measurement was performed 20 minutes and 60 minutes after the heating started at time T1. The odor indexes in Table 1 were calculated as follows. First, the exhaust including odorous substances was diluted until the concentration of the odorous substances was a predetermined value, and the dilution rate at that time was obtained. Next, the logarithm of the dilution rate was taken. Multiplying ten to the logarithm gave the odor index. Therefore, the smaller the odor index, the more odor substances were decomposed, that is to say, the more the exhaust was deodorized.

TABLE 1

| | Effect of Photo Catalyst | | | |
|---|---|---|---|---|
| | Dilution rate | | Odor index | |
| Elapsed time | 20 mins | 60 mins | 20 mins | 60 mins |
| Photo catalyst is activated | 173 | 173 | 22 | 22 |
| Photo catalyst is not activated | 1700 | 550 | 32 | 27 |

As is clear from Table 1, in the case where the photo-catalyst was not activated, when the paper bundle 1 were heated, an odor was produced. In this case, the odor index of the odorous substances was 32 at 20 minutes after the start of the heating. Even at 60 minutes after the start of the heating, the odor index was 27, which still represented a high level odor index.

On the other hand, in the case where the photo-catalyst was activated, the odor index was 22 at 20 minutes after the start of the heating. This represented a low level odor index compared with the case where the photo-catalyst was not activated. At 60 minutes after the start of the heating, the odor index did not change from the value at 20 minutes after the start of the heating. That is to say, due to the photo-catalyst reaction, the odor index was reduced immediately after the start of the heating. It was confirmed that the odor substances were decomposed and the exhaust was deodorized.

Herein, as described above, the oxygen in the air reacts by the electric discharge between the voltage terminals 34 and the ozone is generated. Then, the odor substances are decomposed by the ozone.

The removal of the excess ozone not used for the decomposition of the odor substances will be performed as follows.

In the image-erasing apparatus 80 of this embodiment, at the time T3, the blower fan 9 is driven and the operation of the power supply 35 is stopped. If the power supply 35 is operated in the cooling process (time T3 to time T4), the generated ozone is discharged by the blower fan 9, and hence, stopping the power supply 35 at time T3 prevents the discharge of ozone.

Since the image-erasing apparatus 80 is provided with the ozone-removing device 37 for decomposing ozone, the discharge of ozone can be prevented more reliably.

As described above, according to the image-erasing apparatus 80 of this eighth embodiment including the photo-catalyst carrier 33, the photo-catalyst carrier 33 carries the photo-catalyst and is disposed between voltage terminals 44, so that the odor substances are decomposed by the light emitted through the electric discharge between the voltage terminals 44. In addition, since the image-erasing apparatus 80 includes the ozone-removing device 37, the average power consumption can be made low, and the discharge of odor can be further reduced.

In the above description, although the substances produced in the erasing process are odor substances, the other chemicals can also be removed by using a suitable filter or a suitable adsorbent.

It is to be further noted that the present invention is not limited to the described embodiments and many other changes, modifications and combinations may be made without departing from the scopes of the appended claims.

What is claimed is:

1. An apparatus for erasing an image formed, on a medium, with an erasable image-forming material by heating the medium, comprising:

a heating unit for electrically heating the image formed, on an medium, with an erasable image-forming material, at a predetermined temperature; and a power source connected to the heating unit so as to supply an electric power thereto to heat the heating unit, said heating unit including two heating plates between which the medium is disposed in a sandwiched state from front and back surface sides of the medium; and two heaters electrically connected to the power source and attached to the heating plates, respectively, for heating the two heating plates.

2. An image-erasing apparatus according to claim 1, further comprising additional two heating plates and two heaters disposed on two side portions, opposing to each other, of the medium so as to surround the medium from four directions by the first mentioned two heating plates and heaters and the latter mentioned two heating plates and heaters.

3. An image-erasing apparatus according to claim 2, further comprising further additional two heating plates and two heaters disposed on two side portions, opposing to each other, other than two sides mentioned above, of the medium so as to surround the medium from six directions by said four heating plates and four heaters and the further mentioned two heating plates and two heaters.

4. An image-erasing apparatus according to claim 1, further comprising two heat reflecting plates disposed on two side portions, opposing to each other, of the medium so as to surround the medium from four directions by the two heating plates and two heat reflecting plates.

5. An image-erasing apparatus according to claim 4, further comprising further additional two heat reflecting plates disposed on two side portions, opposing to each other, other than two sides mentioned above, of the medium so as to surround the medium from six directions by the two heating plates and the first mentioned two heat reflecting plates and the latter mentioned two heat reflecting plates.

6. An image-erasing apparatus according to claim 1, further comprising a tray in which the medium is placed and which is heated by the heating unit.

7. An image-erasing apparatus according to claim 1, further comprising a fan disposed so as to blow air to the heating unit to cool the same.

8. An image-erasing apparatus according to claim 1, further comprising a heat-blocking plate operatively connected to a surface of the heating unit opposing to a surface contacting to the heating unit on at least one of front and back surface sides of the medium so as to reflect the heat from the heating unit.

9. An image-erasing apparatus according to claim 8, further comprising two heat-blocking plates disposed on outsides of both the heating units through a spacer on one side and an elastic member on the other side.

10. An image-erasing apparatus according to claim 9, wherein said elastic member includes a plurality of springs.

11. An image-erasing apparatus according to claim 1, further comprising an outer case in which the heating unit and a fan for cooling the heating unit are disposed, said case being provided with an air inlet through which air is introduced inside the case and an air outlet through which the air is discharged outside the case.

12. An image-erasing apparatus according to claim 11, comprising a control unit disposed in the case and electrically connected to the heating unit and the fan for automatically controlling an operation of the heating unit and the fan.

13. An image-erasing apparatus according to claim 12, wherein an interlock mechanism is further disposed in the case for interlocking the case.

14. An image-erasing apparatus according to claim 12, wherein a handle is attached to the case so as to carry the case.

15. An image-erasing apparatus according to claim 11, further comprising a substance treating unit, disposed outside the case at a portion adjacent to the air outlet provided in the case for decomposing and then adsorbing a substance generated at a time of heating and erasing the image formed on the medium.

16. An image-erasing apparatus according to claim 15, wherein said substance treating unit includes a photo-catalyst carrier for carrying a photo-catalyst, at least one pair of voltage terminals for applying voltage to the photo-catalyst carrier disposed between the paired voltage terminals, and a power source for supplying a power to the voltage terminals.

17. An image-erasing apparatus according to claim 16, further comprising an ozone treating device for decomposing ozone generated by discharge between the paired terminals.

18. An image-erasing apparatus according to claim 17, wherein the ozone treating device and the photo-catalyst carrier are integrated as a unit.

19. An image-erasing apparatus according to claim 16, wherein the substance treating unit and the heating unit are synchronously operated.

20. An image-erasing apparatus according to claim 15, wherein the substance treating unit includes an adsorption device for adsorbing the substance generated at the time of heating and erasing the image formed on the medium.

21. An image-erasing apparatus according to claim 11, further comprising a substance treating unit, disposed inside the case at a portion adjacent to the air outlet provided in the case for decomposing and then adsorbing a substance generated at a time of heating and erasing the image formed on the medium.

22. An image-erasing apparatus according to claim 1, wherein the medium is heated at a predetermined temperature in a range of 120° C. to 150° C.

23. An apparatus for erasing an image formed, on a medium, with an erasable image-forming material by heating the medium, comprising:

a heating unit for electrically heating the image formed, on an medium, with an erasable image-forming material, at a predetermined temperature; and a power source connected to the heating unit so as to supply an electric power thereto to heat the heating unit, said heating unit including a single heating plate and a single heater attached to the heating plate, and further comprising three heat reflecting plates including one heat reflecting plate disposed so as to face the heating plate so as to sandwich the medium therebetween and two heat reflecting plates disposed on front and back side surfaces of the medium so as to surround the medium from four directions by the one heating plate and three heat reflecting plates.

24. An image-erasing apparatus according to claim 23, further comprising further additional two heat reflecting plates disposed on two side portions, opposing to each other, other than said front and back side surfaces, of the medium so as to surround the medium from six directions by the one heating plate and the first mentioned three heat reflecting plates and the latter mentioned two heat reflecting plates.

25. A method of erasing an image formed, on a medium, with an image-erasable material comprising the steps of:

preparing a heating unit and putting a medium on the heating unit;

heating the heating unit so as to heat the medium at a predetermined temperature;

preparing a substance treating unit including a photo-catalyst on a downstream side of the heating unit and; and decomposing, through a photo-catalyst reaction, an odor component contained in the substance and generated during the heating step.

26. An image-erasing method according to claim 25, wherein the medium is heated at a predetermined temperature in a range of 120° C. to 150° C.

27. A method of erasing an image formed, on a medium, with an image-erasable material comprising the steps of:

preparing a heating unit and putting a medium on the heating unit;

heating the heating unit so as to heat the medium at a predetermined temperature; and preparing a substance treating unit including an absorption device for absorbing a substance generated in the heating step.

* * * * *